US007854220B1

(12) United States Patent
Neumaster

(10) Patent No.: US 7,854,220 B1
(45) Date of Patent: Dec. 21, 2010

(54) STRETCHABLE TENSION PAINTBALL AGITATOR WITH DEFLECTING ARMS AND DISPLACEMENT TIPS

(76) Inventor: Terry Neumaster, 108 N. Melody, Lowell, AR (US) 72745

( * ) Notice: Subject to any disclaimer, the term of this patent is extended or adjusted under 35 U.S.C. 154(b) by 466 days.

(21) Appl. No.: 11/801,331

(22) Filed: May 9, 2007

Related U.S. Application Data

(60) Provisional application No. 60/799,447, filed on May 11, 2006.

(51) Int. Cl.
*F41B 11/02* (2006.01)

(52) U.S. Cl. ..... 124/51.1

(58) Field of Classification Search ..... 124/51.1
See application file for complete search history.

(56) References Cited

U.S. PATENT DOCUMENTS

| | | | | |
|---|---|---|---|---|
| 1,403,719 | A | 1/1922 | Szepe | |
| 1,404,689 | A | 1/1922 | Fairweather | |
| 1,743,576 | A | 1/1930 | Smith | |
| 3,248,008 | A | 4/1966 | Meierjohan | 221/205 |
| 3,610,223 | A | 10/1971 | Green | 124/16 |
| 3,695,246 | A | 10/1972 | Filippi et al. | 124/11 |
| 3,844,267 | A | 10/1974 | Mohr | 124/1 |
| 3,867,921 | A | 2/1975 | Politzer | 124/26 |
| 4,027,646 | A | 6/1977 | Sweeton | 124/56 |
| 4,207,857 | A | 6/1980 | Balka, Jr. | 124/56 |
| 5,097,985 | A | 3/1992 | Jones | 221/86 |
| 5,166,457 | A | 11/1992 | Lorenzetti | 42/49.01 |
| 5,282,454 | A | 2/1994 | Bell et al. | 124/49 |
| 5,505,188 | A | 4/1996 | Williams | 124/74 |
| 5,816,232 | A | 10/1998 | Bell | 124/51.1 |
| 5,947,100 | A | 9/1999 | Anderson | 124/45 |
| 5,954,042 | A * | 9/1999 | Harvey | 124/51.1 |
| 6,305,367 | B1 | 10/2001 | Kotsiopoulos et al. | 124/49 |
| 6,418,919 | B1 | 7/2002 | Perrone | 124/49 |
| 6,481,432 | B2 | 11/2002 | Rushton et al. | 124/49 |
| 6,701,907 | B2 * | 3/2004 | Christopher et al. | 124/48 |
| 6,725,852 | B1 | 4/2004 | Yokota et al. | 124/49 |
| 6,889,680 | B2 * | 5/2005 | Christopher et al. | 124/51.1 |
| 7,222,617 | B2 * | 5/2007 | Andresen | 124/51.1 |
| 7,357,130 | B2 * | 4/2008 | Broersma | 124/51.1 |
| 2006/0086347 | A1 * | 4/2006 | Hedberg | 124/51.1 |

* cited by examiner

*Primary Examiner*—John Ricci
(74) *Attorney, Agent, or Firm*—Keisling & Pieper PLC; David B. Pieper

(57) ABSTRACT

A spring tensioned paintball agitator using a stretchable tension device providing increased maintenance and replacement access. A base frame and a finger frame are provided defining a movement limit device to prevent overextension of the spring while maintaining a minimum spring position. The agitator includes vertical ball displacement tips for increasing ball agitation inside the hopper and contact finger having a variable contact face for ball position control.

8 Claims, 5 Drawing Sheets

STRETCHABLE TENSION PAINTBALL AGITATOR WITH DEFLECTING ARMS AND DISPLACEMENT TIPS

CROSS-REFERENCE TO RELATED APPLICATIONS

This application claims priority to and is a continuation of U.S. Provisional application Ser. No. 60/799,447, filed May 11, 2006.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of paintball hoppers. In particular, the present invention relates specifically to a tension agitator using a stretch spring to overcome the prior art winding and unwinding spring limitations. The present invention also teaches deflection arms on the agitator and displacement tips for improved ball placement.

2. Description of the Known Art

As will be appreciated by those skilled in the art, paintball hoppers are used to load paintballs into markers for launching. Patents disclosing information relevant to paintball hoppers include U.S. Pat. No. 1,403,719, issued to Szepe on January, 1922; U.S. Pat. No. 1,404,689, issued to Fairweather on January, 1922; U.S. Pat. No. 1,743,576, issued to Smith on January, 1930; U.S. Pat. No. 3,248,008, issued to Meierjohan on April, 1966; U.S. Pat. No. 3,610,223, issued to Green on October, 1971; U.S. Pat. No. 3,695,246, issued to Filippi on October, 1972; U.S. Pat. No. 3,844,267, issued to Mohr on October, 1974; U.S. Pat. No. 3,867,921, issued to Politzer on February, 1975; U.S. Pat. No. 4,027,646, issued to Sweeton on June, 1977; U.S. Pat. No. 4,207,857, issued to Balka on June, 1980; U.S. Pat. No. 5,097,985, issued to Jones on March, 1992; U.S. Pat. No. 5,166,457, issued to Lorenzetti on Nov. 24, 1992; U.S. Pat. No. 5,282,454, issued to Bell on February, 1994; U.S. Pat. No. 5,505,188, issued to Williams on April, 1996; U.S. Pat. No. 5,816,232, issued to Bell on Oct. 6, 1998; U.S. Pat. No. 5,947,100 issued to Anderson on Sep. 7, 1999; U.S. Pat. No. 6,305,367 issued to Kotsiopoulos, et al. on Oct. 23, 2001; U.S. Pat. No. 6,418,919 issued to Perrone on Jul. 16, 2002; U.S. Pat. No. 6,481,432 issued to Rushton, et al. on Nov. 19, 2002; and U.S. Pat. No. 6,725,852 issued to Yokota, et al. on Apr. 27, 2004. Each of these patents are hereby expressly incorporated by reference in their entirety.

U.S. Pat. No. 5,816,232, issued to Bell on Oct. 6, 1998 entitled Paintball loader having active feed mechanism. The abstract provides the following information. An active feed loader for a paintball gun. The active feed loader includes a generally horizontal interior passageway or channel having a first end in communication with an interior space of the housing where paintballs are housed. A rotatable paddle positioned in the interior space forces paintballs out of the housing and through the interior passageway or channel until they drop through an opening therein into a vertical outfeed tube where they form a paintball stack. When the paintball gun is fired, the paintball stack is depleted until a sensor detects the absence of a paintball at a specified location within the outfeed tube. Upon detecting the absence, the sensor activates a motor which rotates the paddle to force paintballs through the interior passageway and into the outfeed tube where they replenish the paintball stack. When the stack is fully replenished, the sensor will detect the presence of a paintball at the specified location and deactivate the motor, thereby stopping the paddle. If the loader includes a channel, an elongated top wall of a directional plug prevents paintballs from dropping into a open top end thereof.

U.S. Pat. No. 5,947,100 issued to Anderson on Sep. 7, 1999 is entitled Paint ball gun agitator sound trigger and duration control. The abstract provides the following information. A paint ball gun includes an agitator mounted on the end of a rotary motor shaft. The agitator has a main shaft that extends transverse to the motor shaft, and two arch wires extending from the main shaft. Each arch wire begins at an end of the agitator shaft and extends vertically therefrom. The arch wires then wrap downward in a partial helix. The end of the arch wires opposite the vertical ends attach to the agitator shaft in a horizontal plane more centrally along the agitator shaft. Rotation of the motor shaft is controlled by an electronic circuit having a duration control which delays turning off the motor for a predetermined interval. The motor will remain activated continuously during a rapid firing sequence. In addition, a magnetic sensor is disclosed to trigger the electronic circuit into energizing the motor. The combination of sensor trigger, duration control and agitator design provide a greatly enhanced paint ball gun capable of operating without jamming or undesired noise during non-firing periods. In addition, the paint ball gun may be capable of rapidly firing more paint balls than previously known in the art, with reduced battery drain. A sound or pressure wave activated sensor such as a pressure or shock sensor or microphone is also disclosed which provides all components necessary for activating the magazine agitator within or immediately adjacent to the agitator motor, thereby simplifying retrofit capability and disassembly, while also improving resistant to paint blockage.

U.S. Pat. No. 6,305,367 issued to Kotsiopoulos, et al. on Oct. 23, 2001 is entitled Hopper feeder. The abstract provides the following information. The present invention provides jam prevention systems for use with a paintball gun having a hollow infeed portion for receiving paintballs to be fired by the gun. The jam free feeder system generally includes a housing, a feed tube, a jam free feeder system, a sensor and a controller. The housing stores a quantity of paintballs. The feed tube is connected to the hollow infeed portion of the housing. The connected feed tube forms a paintball feed passageway for receiving and holding a stack of paintballs and sequentially delivering the paintballs to the paintball gun. A jam free feeder is provided, which is selectively operable to prevent jamming of paintballs in the housing. The sensor senses the firing of the paintball gun and a controller operates the jam free feeder in response to the firing of the paintball gun. Embodiments where the jam free feeder system is a hopper feeder system or a conveyor system are also provided.

U.S. Pat. No. 6,418,919 issued to Perrone on Jul. 16, 2002 is entitled Paintball loader with vibrating mechanism to prevent jamming. The abstract provides the following information. A bulk loader for supplying paintballs to a paintball gun including a loader housing for internally storing a quantity of paintballs, this housing having a bottom outlet through which paintballs can sequentially drop. A feed tube is connected to this housing at the outlet and extends downwardly therefrom. A paintball moving device which can take the form of a vibrator housing, is mounted in the loader housing and is capable of vibrating in order to move paintballs located near the bottom outlet. A vibrator, which can include a small electrical motor, causes the moving device to vibrate when a paintball jam must be freed up. Preferably the vibrator is mounted in the housing forming the moving device. A control mechanism controls the operation of the vibrator and includes a switch mounted in or adjacent to the feed tube for sensing the absence of a paintball within the feed tube. The vibrator can include a vibration causing weight that is mounted on the output shaft of the motor. The preferred switch comprises a magnetic switch.

U.S. Pat. No. 6,481,432 issued to Rushton, et al. on Nov. 19, 2002 is entitled Paintball hopper. The abstract provides the following information. A paintball hopper for connection to a paintball launcher or marker has a counter which includes a flexible potentiometer extending into a transfer conduit that connects to the paintball launcher or marker. The hopper has a reservoir shaped for movement of the paintballs toward the transfer conduit. The hopper has a nose with slanted surfaces that are deflection engineered to enhance the deflectability of paintballs directed at the user. The counter mechanism includes a timer and an LCD display so the user can see how many paintballs have been launched and monitor time. The hopper also includes an agitator to agitate the paintballs in the reservoir.

U.S. Pat. No. 6,725,852 issued to Yokota, et al. on Apr. 27, 2004 is entitled Free-flowing paintball hopper. The abstract provides the following information. An ammunition magazine for dispensing uniformly-sized spherical projectiles such as paintballs into a gun adapted to shoot said projectiles has a generally oblong, closed container having a channel defined in its bottom from a distal axial end to an outlet port located in a lowermost, median portion of the container. The proximal portion of the container floor defines a slanted platform which extends above and beyond the outer port so that projectiles are urged by the platform toward the distal end of the channel from where they roll under the platform and into the outlet port. A helicoidal stirring arm projects from a distal area of the platform obliquely over the exposed part of the channel. The steering arm is driven by an electrical motor controlled by a switch conveniently mounted on the side of the magazine. The arm spins in a ball-uplifting direction to break any jamming of the balls above the channel. The outlet port extends into a tubular section having radial fins which allow the escape of blown-back gases between the tubular section and the internal wall of the gun projectile inlet.

Thus, it may be seen that these prior art patents are very limited in their teaching and utilization, and an improved paintball agitator is needed to overcome these limitations.

SUMMARY OF THE INVENTION

The present invention is directed to an improved paintball agitator. In accordance with one exemplary embodiment of the present invention, a paintball agitator is provided using a drive frame and a finger frame including at least one contact finger outwardly radiating from the finger frame. The drive frame and the finger frame are connected by a stretchable tension storage device mounted on a movement rack.

A movement limit device is provided having a vertical tower on the drive frame interworking with a slot on the finger frame to prohibit overextension and maintain a minimum tension of the stretchable tension storage device. The stretchable tension storage device is generally a coil spring that is easy to replace and maintain without removal form the agitator.

The finger frame includes contact fingers having a varying contact face adapted to move the paintball. The preferred embodiment uses a deflecting face adapted to move the paintball out of the path of the contact finger and a back face connected with a forward radius fillet to maintain the position of a paintball against the contact finger when the agitator is reversed. The back face also has a reverse curvature end adapted to move the paintball out of the path of the contact finger when the agitator is driven backwards.

A conic is attached at the top of the agitator and the finger frame extends past the conic with an exterior rim having vertical ball displacement tips that agitate the paintballs during rotation.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
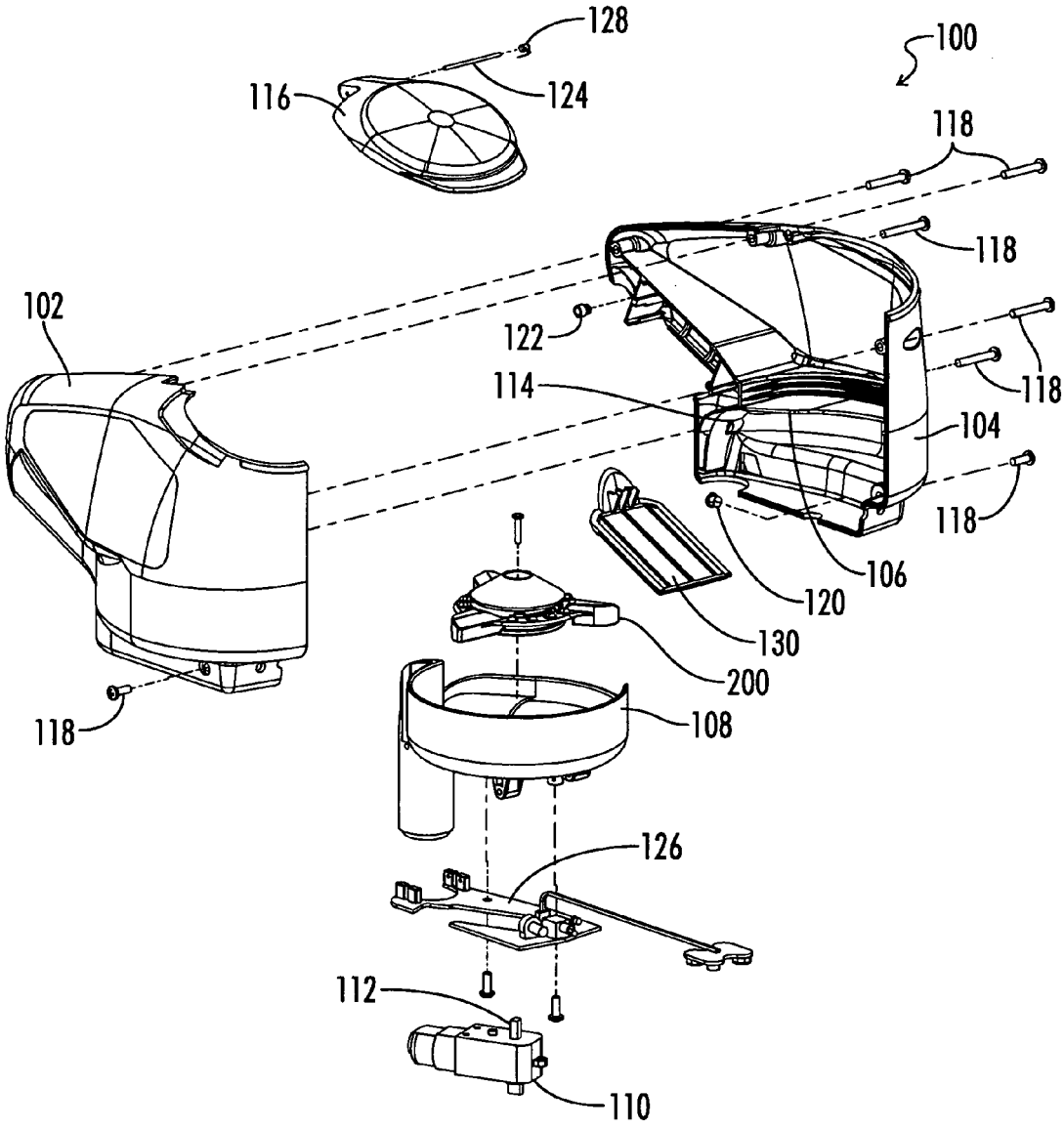
FIG. 1 is an exploded view of a paintball hopper showing the environment of the agitator of the present invention.
Figure 2:
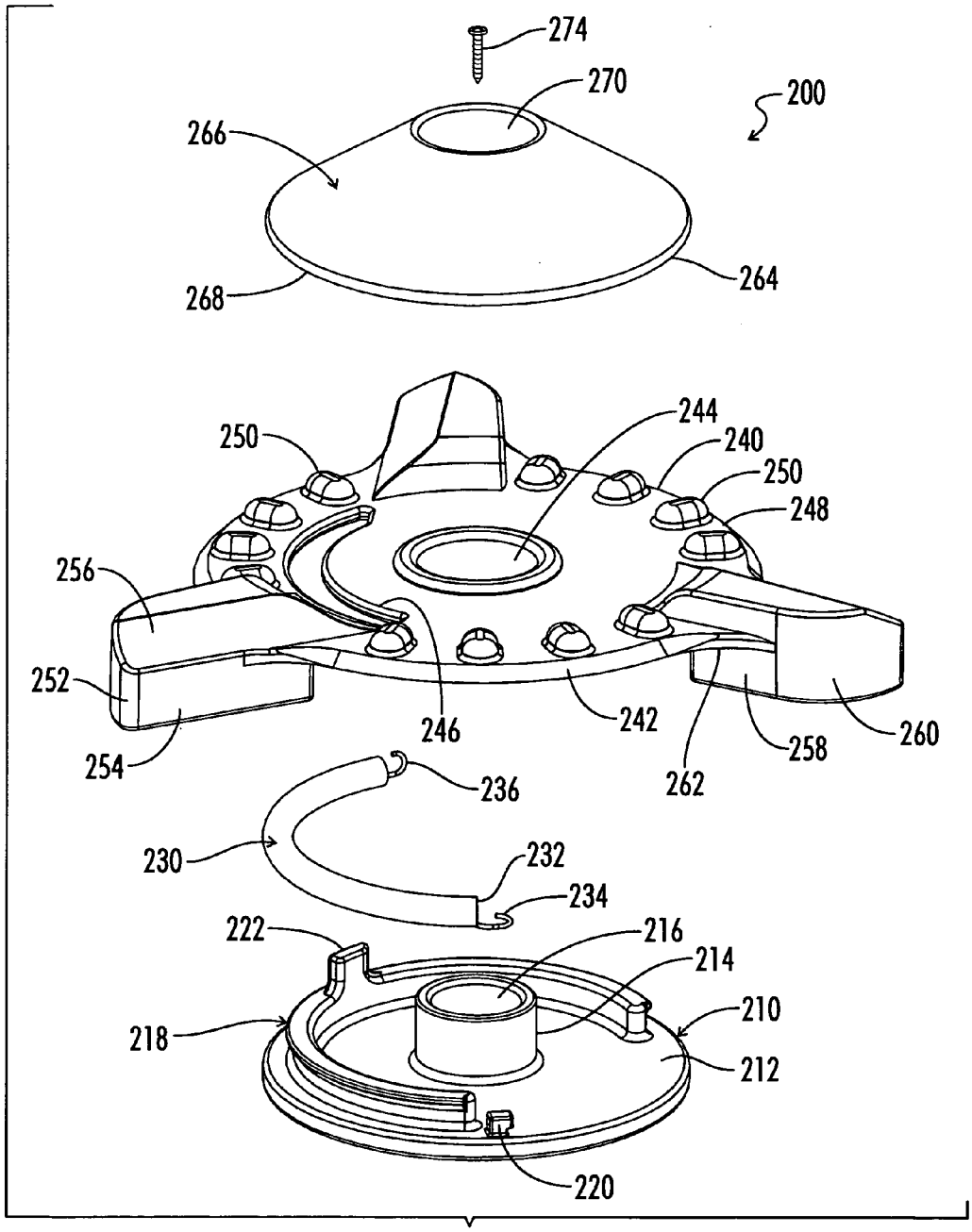
FIG. 2 is an exploded view of the paintball agitator.
Figure 3:
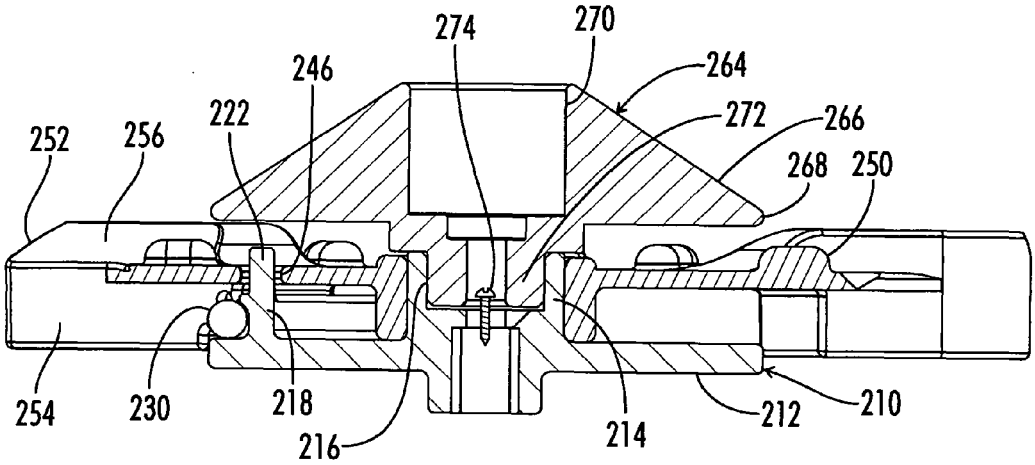
FIG. 3 is a cutaway view of the assembled agitator of FIG. 2.

As shown in FIG. 1 of the drawings, one exemplary embodiment of the paintball agitator 200 of the present invention is generally shown in its environment of a paintball hopper 100. The paintball hopper 100 includes an outer shell assembled from a left housing 102 and a right housing 104 held together by body screws 118. Of particular note is the formation inside the right housing of the deflector extension 106 which acts to direct paintballs into the exit or back up into the main body of the hopper. The deflector extension 106 extends over the raceway 108 and the arms of the agitator 200 such that a paintball either goes below the deflector 106 into the exit port 114, or above the deflector 106 back into the hopper area. In this manner, the deflector 106 works with the shape of the raceway 108 and the paintball agitator 200 to drive the paintballs. The agitator is driven by a motor drive 110 with a drive shaft 112 that connects to the bottom of the paintball agitator 200. The agitator 200 directs paintballs to the exit port 114. Paintballs are inserted into the hopper area through the top opening covered by a lid 116 secured with a lid pin 124 and biased into an open position for loading by the lid spring 128. Similarly, a hinge insert 122 is used to secure the battery door 130. A circuit board 126 is provided to generate the signal for the motor drive 110 and a light pipe 120 is provided to direct light indicator signals such as LED flashes from the circuit board through the body to the user.

FIGS. 2 through 7 show the paintball agitator 200. The paintball agitator 200 includes a drive frame 210 formed with a base disk 212 and an upwardly extending cylindrical axle 214 defining a conic mating aperture 216 for connection to the conic 264. A supporting guide shown as the movement rack 218 provides a seat for the stretchable tension storage device 230 which shown as a coil spring 232. A spring catch 220 is provided for connecting the first end 234 of the spring 220. A limit extension section 222 extends upward to mate with the limit slot section 246 for limiting the movement of the finger frame 240 in relation to the base disk 212.

The stretchable tension storage device 230 is preferably a coil spring 232 with a first end 234 connected to the base disk 212 and a second end 236 connected to the finger frame 240. This allows the finger frame 240 to be rotated in relation to the base disk 212 by stretching the extension spring 232 to provide a tension to the finger frame 240. Note that the present invention uses an extension helical spring which provides significant advantages over the spiral springs taught in the prior art. One advantage of the present invention is found in the normal operation of the hopper. Due to age, weather, or other factors, paintballs will inevitably get broken and drain their oil or gel-filled contents into the mechanics of the hopper. This gel or oil tends to bind the mechanics of the hopper such that maintenance is required. This maintenance requires access to these operating mechanics. The extension helical spring of the present invention does not rely on the ability to converge a center location and may thus be kept on the perimeter of the connection between the base disk 212 and the finger frame 240. This exterior connection allows for the agitator assembly 200 of the present invention to be cleaned without disassembling the agitator. In contrast, the prior art coil springs require complete disassembly to reach the inside windings of the spiral spring. Thus, the present invention is easier to maintain and clean in comparison to the prior art designs.

In addition to the ease of cleaning advantage of the present design, the exterior placement of the helical spring allows for easy replacement of the spring and customizing of the spring type, strength, number of coils, etc. . . . . Thus, the present invention may be easily modified by changing out the spring type without the complete disassembly required by the prior art.

Finally, the extension helical spring is stretched and compressed in operation in contrast to the coiling and uncoiling of the spiral springs of the prior art. This is a more consistent type of spring action such that improved level of control may be obtained by utilizing the helical spring.

In addition to the advantages of the spring, additional advantages are found in the finger frame 240. The finger frame 240 is built using a finger disk 242 having a central rotational aperture 244 that spins on the upwardly extending cylindrical axle 214 of the base disk 212. The limit slot section 246 works with the extension 222 to control the minimum and maximum positions of the finger frame 240 in relation to the drive frame 210. The exterior rim 248 of the finger frame 240 includes vertical ball displacement tips 250 which vertically agitate the paintballs during rotation to creates an improved ability of the paintballs to drop in front of the contact fingers 252. A still further improvement is found in the contact finger 252 defining a pushing face 254 and an angled deflecting face 256 that allows for properly seated ball to be advanced through the exit while improperly seated balls are pushed out of the way and back into the hopper for later use. The back face 258 of the contact finger is designed with a reverse curvature end 260 and a forward radius fillet 262 to improve the reversing performance of the agitator 200 and allow for the clearing of paintball jams via back rotation.

The top of the agitator 200 is a conic 264 defining a top surface 266 and an outside edge 268 which directs paintballs onto the vertical ball displacement tips 250 and then in front of the contact fingers 252. The conic 264 includes a central recess 270 providing a recess for an agitator screw 274 that attaches the mating extension 272 to the base disk 212.

Figure 4:
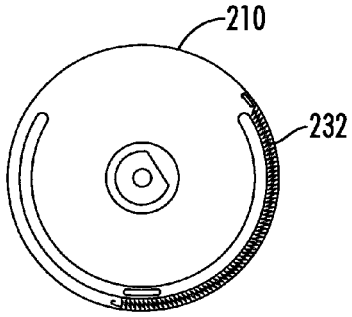
FIG. 4 is a top view of the drive frame and compacted coil spring.
Figure 6:
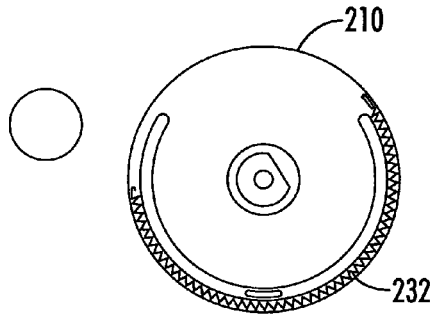
FIG. 6 is a top view of the drive frame and the stretched coil spring.
Figure 5:
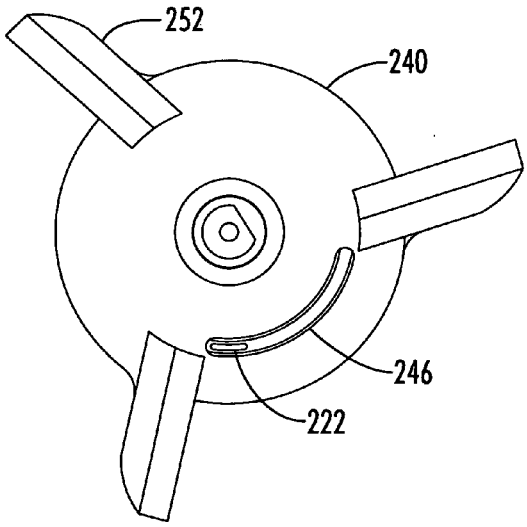
FIG. 5 is a top view of the finger frame position associated with the drive frame and compacted spring position of FIG. 4 at the compacted movement limit.
Figure 7:
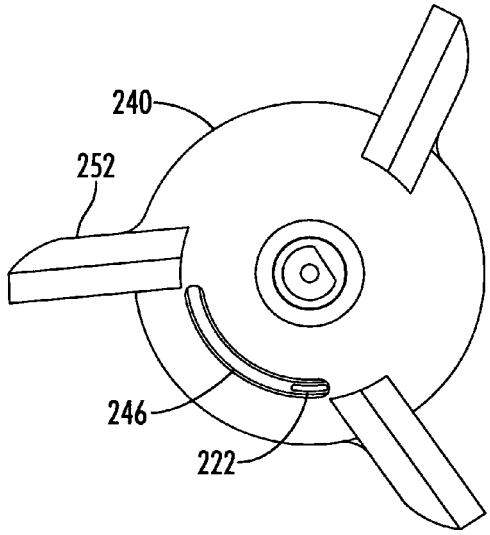
FIG. 7 is a top view of the finger frame position associated with the drive frame and stretched spring position of FIG. 6 at the stretched movement limit.

The stretching and compression of the spring 232 is shown in FIGS. 4 through 7. FIG. 4 shows the compacted coil spring 232 on the base frame 212 and FIG. 5 shows the finger frame installed over the base frame 212 with the limit extension section 222 in the compressed or minimum position in the limit slot section 246. FIG. 6 then shows the drive frame 212 and the stretched coil spring 232. Finally, FIG. 7 shows the tensioned finger frame 240 position associated with the drive frame 212 and the stretched spring 232 position of FIG. 6 with the limit extension section 222 at the stretched movement limit in the limit slot section 246.

Figure 8:
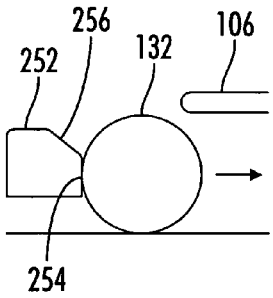
FIG. 8 shows how the pushing face directs properly seated paintballs to the exit.
Figure 9:
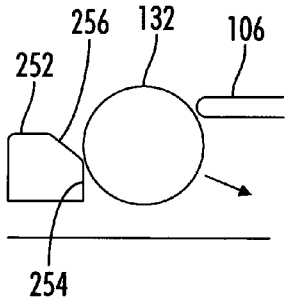
FIG. 9 shows how the pushing face works with the deflector extension to direct slightly offset paintballs to the exit.
Figure 10:
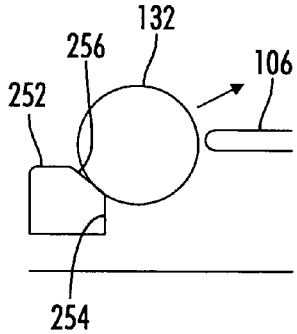
FIG. 10 shows how the deflecting face works with the deflector extension to direct substantially offset paintballs back into the hopper.

FIG. 8 shows a schematic of how the pushing face directs properly seated paintballs to the exit. FIG. 9 shows how the pushing face works with the deflector extension to direct slightly offset paintballs to the exit. Note how the top of the pushing face and the deflect for a line that is above the center point of the paintball such that the paintball is pushed down into the exit port. FIG. 10 shows how the deflecting face works with the deflector extension to direct substantially offset paintballs back into the hopper by pushing them up and out of the way of the contact finger. Here, the paintball center is above the line of the pushing face and the deflector. Thus, by utilizing a varying face on the contact finger in association with the prior art deflector, the paintball position may be controlled with a reduction in the possibility of jamming inside the paintball hopper.

Reference numerals used throughout the detailed description and the drawings correspond to the following elements:

a paintball hopper 100
a left housing 102
a right housing 104
a deflector extension 106
a raceway 108
a motor drive 110
a drive shaft 112
an exit port 114
a lid 116
body screws 118
pipe light 120 insert 122
lid pin 124
circuit board 126
lid spring 128
battery door 130
a paintball 132
a paintball agitator 200
a drive frame 210
base disk 212
cylindrical axle 214
conic mating aperture 216
a movement rack 218
spring catch 220
limit extension section 222
a stretchable tension storage device 230
a coil spring 232
a first end 234
a second end 236
a finger frame 240
finger disk 242
rotational aperture 244
limit slot section 246
an exterior rim 248
vertical ball displacement tips 250
a contact finger 252
a pushing face 254
a deflecting face 256
a back face 258
a reverse curvature end 260
a forward radius fillet 262
a conic 264
top surface 266
outside edge 268
central recess 270
mating extension 272
agitator screw 274

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically referring to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures.

What is claimed is:

1. A paintball agitator apparatus for use in a paintball hopper including a drive shaft and an exit port for directing a paintball, the agitator apparatus comprising:

a drive frame including an upward extension;

a finger frame including at least one contact finger outwardly radiating from the finger frame and the finger frame including a mating slot for the upward extension;

a stretchable tension storage device connecting the drive frame to the finger frame.

2. A paintball agitator apparatus for use in a paintball hopper including a drive shaft and an exit port for directing a paintball, the agitator apparatus comprising:

a drive frame;

a finger frame including at least one contact finger outwardly radiating from the finger frame each contact finger defining: a back face connected to the finger frame by a forward radius fillet, wherein the forward radius fillet is adapted to maintain the position of a paintball against the contact finger;

a stretchable tension storage device connecting the drive frame to the finger frame.

3. A paintball agitator apparatus for use in a paintball hopper including a drive shaft and an exit port for directing a paintball, the agitator apparatus comprising:

a drive frame;

a finger frame including at least one contact finger outwardly radiating from the finger frame each contact finger defining: a back face defining a reverse curvature end adapted to move the paintball out of the path of the contact finger when the agitator is driven backwards; and a stretchable tension storage device connecting the drive frame to the finger frame.

4. A paintball agitator apparatus for use in a paintball hopper including a drive shaft and an exit port for directing a paintball, the agitator apparatus comprising:

a drive frame;

a finger frame including at least one contact finger outwardly radiating from the finger frame, the finger frame defining vertical ball displacement tips; and a stretchable tension storage device connecting the drive frame to the finger frame.

5. A paintball agitator apparatus for use in a paintball hopper including a drive shaft and an exit port for directing a paintball, the agitator apparatus comprising:

a finger frame including at least one contact finger outwardly radiating from the finger frame;

each contact finger defining a varying contact face adapted to move the paintball, the varying contact face including a pushing section adapted to move the paintball out of the exit and a deflecting section adapted to move the paintball out of the path of the contact finger;

a conic upwardly extending from the finger frame; and the finger frame defining an exterior rim extending past the conic.

6. A paintball agitator apparatus for use in a paintball hopper including a drive shaft and an exit port for directing a paintball, the agitator apparatus comprising:

a finger frame including at least one contact finger outwardly radiating from the finger frame;

each contact finger defining a varying contact face adapted to move the paintball, the varying contact face including a pushing section adapted to move the paintball out of the exit and a deflecting section adapted to move the paintball out of the path of the contact finger; and the finger frame defining vertical ball displacement tips.

7. A paintball agitator apparatus for use in a paintball hopper including a drive shaft and an exit port for directing a paintball, the agitator apparatus comprising:

a finger frame including at least one contact finger outwardly radiating from the finger frame;

each contact finger defining a varying contact face adapted to move the paintball, the varying contact face including a pushing section adapted to move the paintball out of the exit and a deflecting section adapted to move the paintball out of the path of the contact finger and a back face connected to the finger frame by a forward radius fillet, wherein the forward radius fillet is adapted to maintain the position of a paintball against the contact finger.

8. A paintball agitator apparatus for use in a paintball hopper including a drive shaft and an exit port for directing a paintball, the agitator apparatus comprising:

a finger frame including at least one contact finger outwardly radiating from the finger frame;

each contact finger defining a varying contact face adapted to move the paintball, the varying contact face including a pushing section adapted to move the paintball out of the exit and a deflecting section adapted to move the paintball out of the path of the contact finger and a back face defining a reverse curvature end adapted to move the paintball out of the path of the contact finger when the agitator is driven backwards.

* * * * *